US006001004A

United States Patent [19]

Botteghi

[11] Patent Number: 6,001,004

[45] Date of Patent: Dec. 14, 1999

[54] PANEL SANDING MACHINE WITH AUTOMATIC CHANGING AND CLEANING OF THE ABRASIVE BELT

[75] Inventor: Gino Botteghi, Rimini, Italy

[73] Assignee: SCM Group, S.p.A., Rimini, Italy

[21] Appl. No.: 09/122,539

[22] Filed: Jul. 24, 1998

[30] Foreign Application Priority Data

Aug. 8, 1997 [IT] Italy ..... BO97A0506

[51] Int. Cl.[6] ..... B24B 7/00; B24B 9/00

[52] U.S. Cl. ..... 451/168; 451/296; 451/300; 451/167

[58] Field of Search ..... 451/166, 167, 451/168, 173, 296, 300, 303, 304, 299, 59, 297, 526, 539, 41, 65, 57, 162, 163, 164

[56] References Cited

U.S. PATENT DOCUMENTS

| | | | |
|---|---|---|---|
| 4,416,090 | 11/1983 | Jonasson | 451/303 |
| 4,601,134 | 7/1986 | Hessemann | 451/303 |
| 4,628,640 | 12/1986 | Johansen | 451/303 |
| 4,651,474 | 3/1987 | David | 451/300 |
| 4,837,984 | 6/1989 | David | 451/300 |
| 4,839,994 | 6/1989 | Heesemann | 451/303 |
| 4,858,265 | 8/1989 | Suzuki et al. | 451/296 |
| 4,864,775 | 9/1989 | David | 451/303 |
| 5,016,400 | 5/1991 | Weber | 451/303 |
| 5,148,639 | 9/1992 | Sakai et al. | 451/59 |
| 5,490,808 | 2/1996 | Jantschek et al. | 451/59 |
| 5,512,009 | 4/1996 | Earl | 451/299 |

*Primary Examiner*—Demis Holt Banks
*Attorney, Agent, or Firm*—Fay, Sharpe, Fagan, Minnich & McKee, LLP

[57] ABSTRACT

A panel sanding machine comprises an abrasive belt and a pad mounted by the machine in such a way that it rotates in orbital fashion around an axis transverse to the plane in which the panels lie and presses the abrasive belt against the panel being machined. The abrasive belt is supported by the pad in such a way that it can slide on the latter in a direction parallel to the panel being machined. The machine also includes a feature for alternately allowing and preventing the sliding of the abrasive belt relative to the pad in two working conditions, of which the first allows the belt to slide so as to change the part of it that is in contact with the panel being worked, and the second locks the belt to the pad so that the panels can be sanded.

10 Claims, 2 Drawing Sheets

PANEL SANDING MACHINE WITH AUTOMATIC CHANGING AND CLEANING OF THE ABRASIVE BELT

BACKGROUND OF THE INVENTION

The present invention relates in general to machines for working panels by removing material and in particular to wooden panel sanding machines.

Up to the present time, industrial sanding machines for wooden panels comprise a power-driven pad, in the form of a bar, that is mounted horizontally over the worktable of the machine on which the panels move forward horizontally and that is equipped with an abrasive belt.

The pad is placed across the worktable of the machine and is supported by two vertical high-speed power spindles driven by a single motor, which drives the two spindles through a toothed belt, which synchronizes their operation. The spindles rotate eccentrically about an axis transverse to the machine worktable.

The orbital motion of the pad allows the abrasive grit on the belt to work the surface of the panel in crisscross fashion. This type of sanding enables the part to be finished better and, when working wooden parts with uprights and crosspieces, where, obviously, the grain directions of the wood cross each other, it permits smoothing of the wooden surface without leaving ugly crossmarks, thus solving a major problem with older generation machines.

The pad is equipped with means for fixing and tensioning the abrasive belt. The belt, which consists of a rectangular strip, is attached with its long sides to the specially shaped sides of the pad and kept tensioned on the pad by a cushion of compressed air blown through special pipes located between the pad and the belt.

During operation, the abrasive belt is pressed against the panel and the sanding action is provided by the combined effect of the thrusting and orbiting motion applied by the pad.

At present, the abrasive belt is changed by hand, resulting in downtime which has negative effects on the economy of the process.

Moreover, since the diameter of the pad's orbit is in the order of just a few millimeters, the dust that accumulates as material is removed from the panel cannot be eliminated until the panel leaves the area where it is in contact with the abrasive belt. Even then, since the dust is removed only by the effect of gravity, the amount of dust eliminated is limited.

The elimination of dust from the abrasive belt is therefore difficult and unsatisfactory. Moreover, since sanding belts typically have a fine grit size with a high number of abrasive particles per unit of surface area, they tend to become easily clogged up with dust which reduces their cutting efficiency. Consequently, to achieve satisfactory machining quality, the abrasive belt must be changed frequently, resulting in further negative effects on the economy of the process.

Another disadvantage is that the abrasive belts have to be specially designed and made according to the fixing and tensioning devices of the pads to which they must be fitted.

The disadvantages described above have recently a become even more critical on account of the development of sanding machines equipped with two orbiting heads placed in line along the panel feed path. In these, the use of a blower located between the two heads to clean at least the surface of a panel as it leaves the first head and before it is fed to the other head, has proved to be a temporary and unsatisfactory solution to these problems.

The aim of the present invention is to overcome the above mentioned disadvantages by providing a solution whereby the abrasive belt is changed automatically and which, by effectively eliminating the dust from the abrasive belt, renders sanding machines more productive and economical to run.

SUMMARY OF THE INVENTION

In accordance with the present invention, the above aim is achieved by a sanding machine in which the abrasive belt is supported by the pad in such a way that it can slide on the latter in a direction parallel to the panel being machined and equipped with means for alternately allowing and preventing the sliding of the abrasive belt relative to the pad in two working conditions, of which the first allows the belt to slide so as to change the part of it that is in contact with the panel being worked, and the second locks the belt to the pad so that the panels can be sanded.

Since the panels are sanded by different parts of the belt, when one part is working on a panel, the inactive parts can be dusted so as to restore their cutting efficiency thereby allowing the surface finish to be made constant in time and, in addition, lengthening the useful life of the abrasive belt.

BRIEF DESCRIPTION OF THE DRAWINGS

The characteristics of the invention according to the above mentioned aims are described in the claims below and the advantages are apparent from the detailed description which follows, with reference to the accompanying drawings, which illustrate a preferred embodiment of the invention and in which:

DESCRIPTION OF THE PREFERRED EMBODIMENTS

Figure 1:
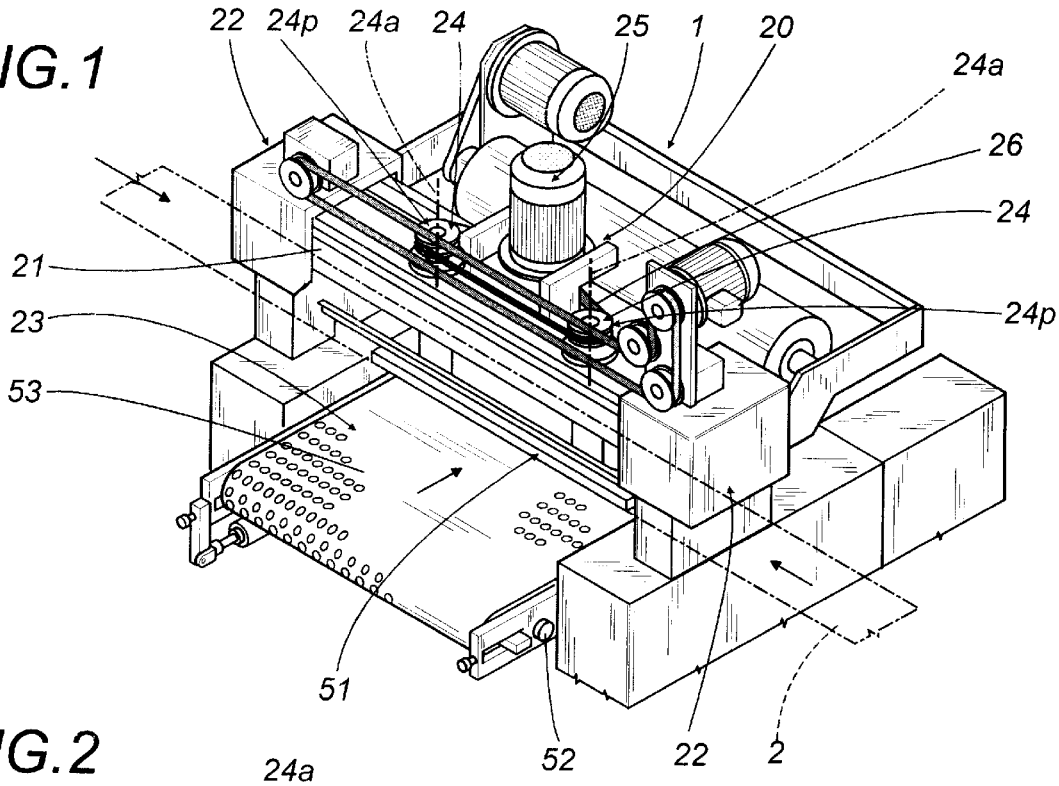
FIG. 1 is a perspective assembly view of a machine made according to the present invention, with some parts cut away in order to better illustrate others.

With reference to the drawings listed above, the numeral 1 indicates as a whole a machine for sanding plane panels 4 consisting, for example and without restricting the scope of the invention, of panels made of wood or an equivalent material used for manufacturing furniture.

The machine essentially comprises a machining head 20 mounted by a horizontal beam 21 supported by two uprights 22 over a work table 23 equipped with a feed apron 53 that moves in a horizontal direction transverse to the beam 21.

Figure 2:
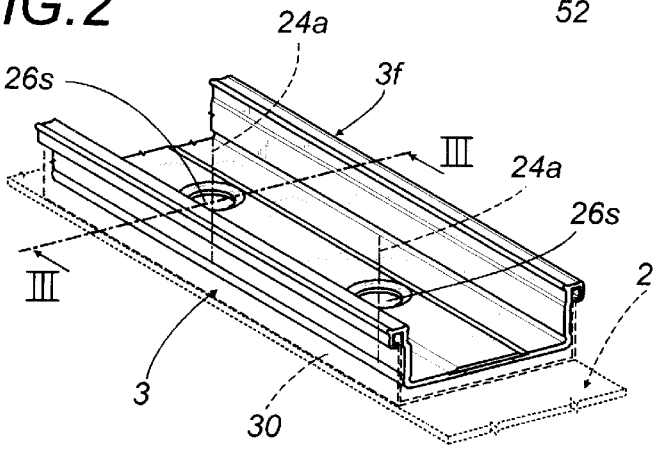
FIG. 2 is a detail view of the machine illustrated in FIG. 1.

The machining head 20 is fitted with a pad 3 (FIG. 2) which comprises a long, extruded aluminum channel **3*f* located under the beam 21 and extending right across the work table 23 of the machine 1**.

The pad 3 is mounted by the beam through two vertical high-speed power spindles 24 driven by a single motor 25 which transmits the rotational motion to them through a transmission belt 26. The belt 26 is toothed and wound in Vee fashion around a pinion of the motor 25 and around driven pulleys 24*p* mounted by the shafts of the spindles 24.

The spindles rotate eccentrically, in known manner, about their vertical axes of rotation 24*a* and support the pad 3 by engaging specially made seats 26*s* in the channel 3*f* forming part of the pad 3. As a result of their eccentric rotation, the eccentricity being in the order of one millimeter, the motion transmitted by the spindles 24 to the pad 3 is orbital, causing the pad 3 to move in a plane that is substantially parallel to the work table 23 of the sanding machine 1.

At opposite ends of the beam 21, the machine 1 comprises two belt magazines 5*a* and 5*b* (FIG. 4), consisting in particular of two reels that rotate about respective horizontal axes X and Y, between which a long strip 2 of abrasive belt extends, said strip of abrasive belt having its ends 2*a* and 2*b* attached to the reels 5*a* and 5*b* and running along the pad 3 on the underside of the channel 3*f*.

The two reels 5*a* and 5*b* have drive means 5*x* and 5*y* that switch the reels 5*a* and 5*b* on and off alternately so that each reel 5*a* or 5*b* alternately drives, or is driven by, the other. The rotations of the reels 5*a* and 5*b* about their axes X and Y cause the belt 2 to slide along the pad 3 in both directions, as shown by the arrow 27, thus being wound round one reel while being at the same time unwound from the other reel.

Since the sliding motion is transmitted to the abrasive belt 2 by switching the drive means 5*x* and 5*y* of the reels 5*a* and 5*b* on and off in the manner described above, it can be seen that in practice the drive means 5*x* and 5*y* can be regarded in more general terms as actuating means which enable the belt 2 to slide along the pad 3 in both directions and that switching them on and off makes it possible, according to requirements, to change the part of the abrasive belt 2 that comes into direct contact with the panel 4 to be machined.

The drive means 5*x* and 5*y* are connected to means for detecting the length of the sliding movement of the belt 2 and hence to control the extent to which the belt slides. These length detecting means consist in particular of an encoder wheel 40 that is in contact with the abrasive belt 2, measuring the length of the latter's sliding movement, and that issues commands to start and stop the drive means 5*x* and 5*y* of the reels 5*a* and 5*b* alternately according to the length traveled by the belt.

The sanding machine 1 is equipped with idle, transfer rollers H and H1 located between the ends of the beam 21 and of the reels 5*a* and 5*b* to keep the abrasive belt 2 tensioned under the pad 3.

The sanding machine 1 is also equipped with retaining means that enable the abrasive belt 2 to be locked to the pad 3 and that are switched on alternately, in synchrony with the means that control the sliding motion of the belt.

Figure 3:
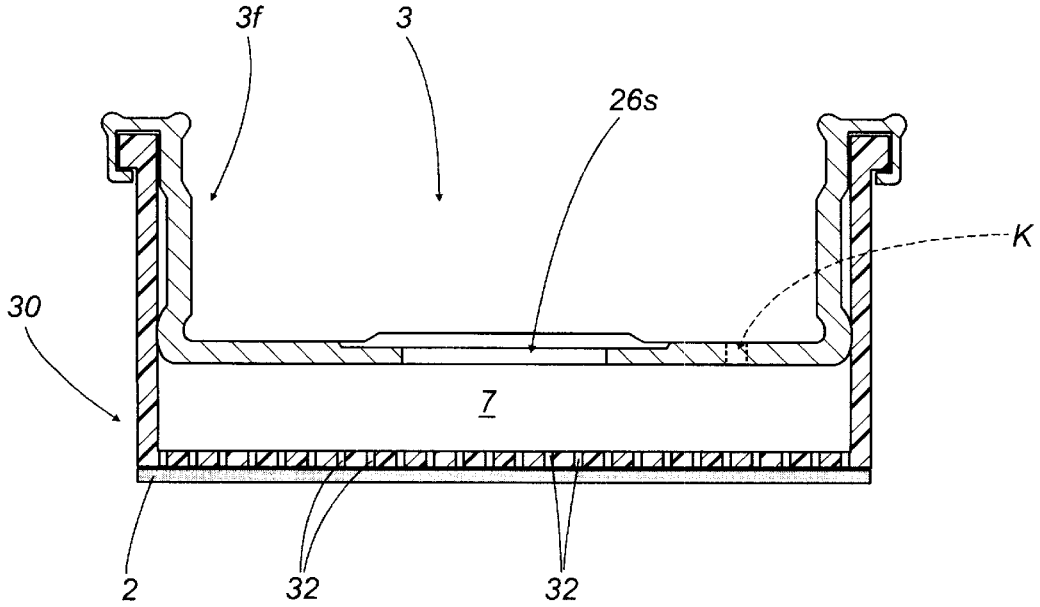
FIG. 3 is a cross section of the detail shown in FIG. 2 cut through line III—III.

Looking in more detail, the retaining means (FIG. 3) comprise a rubber element 30, whose cross section has the shape of a channel, attached to the sides of the section 3*f* and placed between the abrasive belt 2 and the horizontal surface of the channel 3*f*.

The rubber element 30 is shaped in such a way as to form, with the channel 3*f*, a vacuum chamber 7 extending along the pad 3 which communicates with the abrasive belt 2 through a set of holes 32 made in the rubber element and which is connected to a vacuum port controlled by a solenoid valve.

When the vacuum in the chamber 7 is on, the abrasive belt 2 adheres closely to the channel 3*f*, and while the abrasive belt 2 is locked to the pad 3 in this way, it is placed in contact with the panel 4 to be machined.

On the contrary, when the vacuum in the chamber 7 is off, the abrasive belt 2 is detached from the pad 3 and allowed to slide freely on the latter in a direction parallel to the panel 4 being machined in order to change the working part of the abrasive belt 2 on the panels 4.

In the middle of the horizontal beam 21, between the reels 5*a* and 5*b*, the sanding machine 1 comprises two cleaning stations 6*a* and 6*b* for restoring the abrasive capacity of the belt 2. These stations, illustrated schematically, are placed adjacent to the abrasive belt 2 and are equipped with dust extraction means. The latter consist, for example, of conventional nozzles which blow compressed air on the belt 2 so as to remove the dust that accumulates during sanding operations and allow it to be carried away from the working area by sliding movements of the abrasive belt 2.

Figure 5:
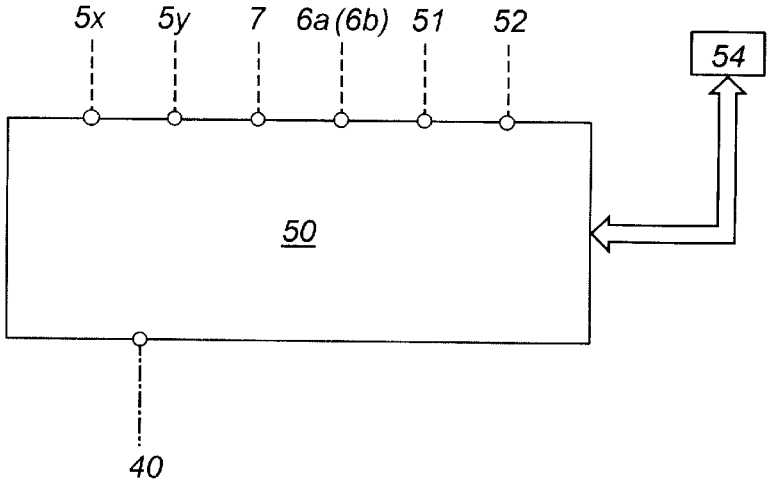
FIG. 5 is a schematic representation of means for controlling the machine 1.

The sanding machine 1 also comprises control means 50 (FIG. 5) which control all the functions of the machine 1 and, in particular, are connected to the actuating means 5*x* and 5*y* that enable the sliding of the belt 2, to the retaining means 7 that lock the abrasive belt 2 to the pad 3, and to the cleaning stations 6*a* and 6*b* so as to switch them on and off automatically in an appropriate synchronized sequence.

The machine 1 described above fully achieves the aims of automatically changing the abrasive belt 2 in that it changes the part of the belt that works the panel and of continuously restoring the abrasive capacity of the belt from one working part to another so as to increase the productivity of the machine 1, with the added advantage over prior art of using conventional abrasive belts 2 which do not require any preliminary work to be carried out on them before being fitted to the machine.

The machine 1 also has a series of features which provide the further advantage of optimized wear management of the abrasive belt 2 so that the latter is used to the full and its useful life is hence increased.

The machine 1 can thus be equipped with first means for detecting the width of the panels 4 consisting of a line of sensors 51 located at the infeed of the machine 1 and with second means for detecting the length of the panels 4 consisting of an encoder 52 connected to the roller that drives the worktable 23 feed apron 53.

A memory device 54 is connected to the control means 50. The latter process the input signals from the line of sensors 51 and from the encoder 52 and calculate the surface area of the panels 4 as they move past the line of sensors 51. The value of this surface area is added to the total surface area machined, which is stored in the memory device 54 and which is continuously updated as the total area of the panels machined, in square meters, increases. The control means 50 also identify the individual parts of the abrasive belt 2 and store in the memory device 54 the total surface area worked by the individual parts of the belt 2. The control means 50 then issue the commands to slide the belt 2 over the pad 3 in such a way as to distribute the workload, and hence belt wear, uniformly over each part of the belt 2. When the surface area worked by the abrasive belt 2 as a whole reaches a preset reference value stored in the memory device 54 and correlated to the useful life of the abrasive belt 2, the control means issue a warning signal indicating that the abrasive belt 2 of the machine 1 must be substituted.

The reference value, correlated to the useful life of the abrasive belt 2 and stored in the memory device 54, is determined on the basis of historical data which takes into account a number of parameters, including the type of wood of which the panels 4 are made, the type of abrasive belt and the feed rate.

The abrasive belt 2 may run from one reel 5*a* to the other 5*b* even two or more times before being substituted. Obviously, the control means 50 control the machine 1 in such a way as to prevent the panels 4 from moving forward when the abrasive belt 2 is moving.

Figure 4:
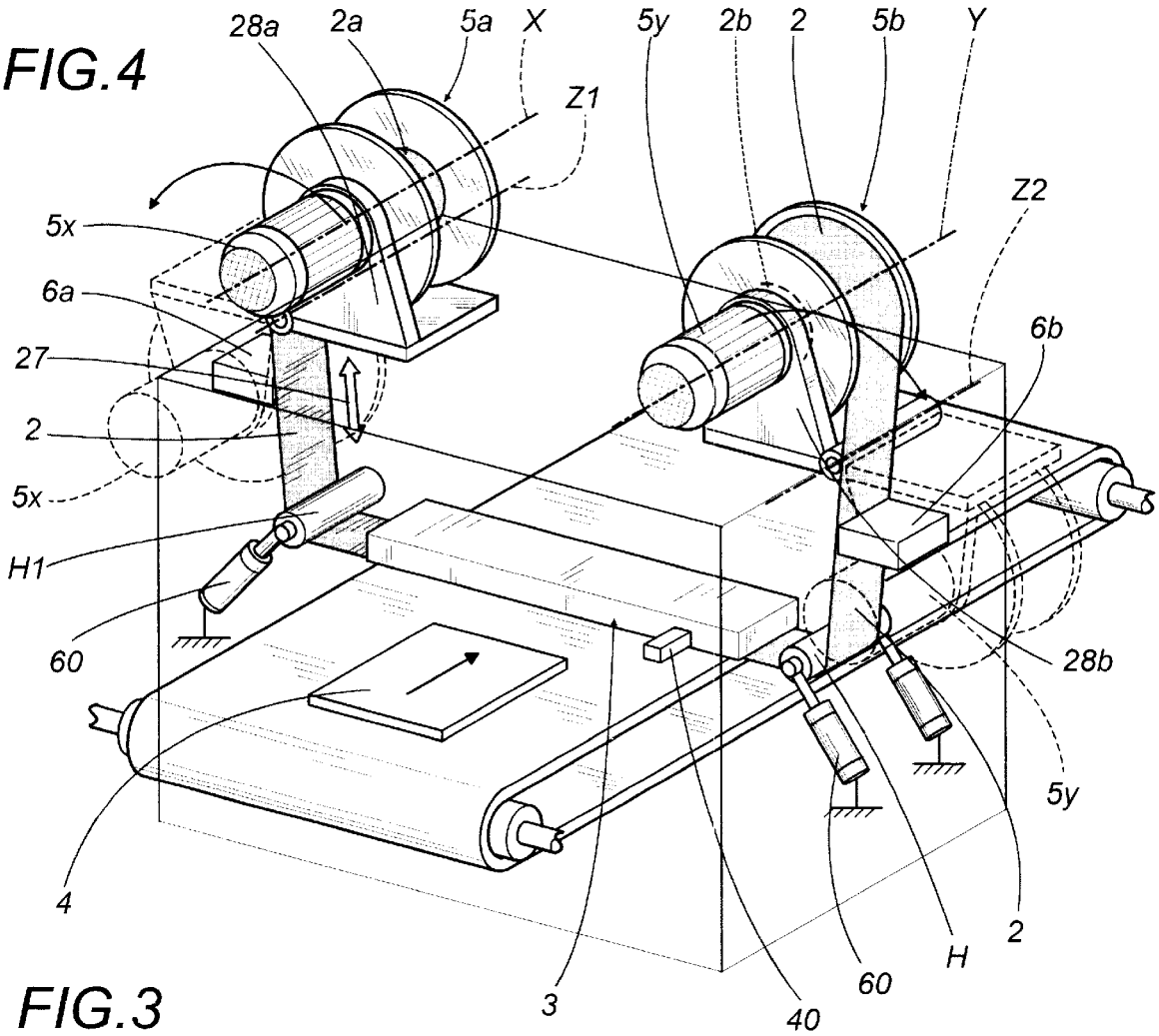
FIG. 4 is a perspective assembly view of the machine made according to the present invention, represented schematically and with some parts cut away in order to better illustrate others.

As regards the substitution of the abrasive belt 2, FIG. 4 shows that the transfer rollers H and H1 are mounted on pneumatic cylinders 60 which enable the belt to be tensioned during machining and to be slackened when it has to be substituted.

In addition, the reels 5*a* and 5*b* are pivotally mounted on supports 28*a* and 28*b* with pins that rotate about horizontal axes Z1 and Z2 in such a way as to allow the reels 5*a* and 5*b* to be lowered (see FIG. 4) below working level to facilitate substitution of the reels 5*a* and 5*b* on both sides of the machine 1.

The invention described can be subject to modifications and variations without thereby departing from the scope of the inventive concept. Moreover, all the details of the invention may be substituted by technically equivalent elements.

What is claimed:

1. A panel sanding machine comprising an abrasive belt and a pad mounted by the machine in such a way that the pad moves in orbital fashion around an axis transverse to the plane in which the panels lie and presses the abrasive belt against the panel being machined, said sanding machine being characterized in that the abrasive belt is supported by the pad in such a way that the abrasive belt can slide on the pad in a direction parallel to the panel being machined, and said machine further comprising retaining means for alternately allowing and preventing the sliding of the abrasive belt relative to the pad in two working conditions, of which the first working condition allows the abrasive belt to slide so as to change a part of the abrasive belt that is in contact with the panel being worked, and the second working condition locks the belt to the pad so that the panels can be sanded.

2. The machine according to claim 1, further comprising two belt magazines located on each side of the pad at opposite ends of the abrasive belt so that when the belt slides on the pad, one magazine has a length of belt fed in to it while the other magazine feeds out a corresponding length of belt.

3. The machine according to claim 2, wherein said belt magazines comprise two reels round which the abrasive belt is wound and each of which alternately drives, and is driven by, the other.

4. The machine according to claim 3, wherein said reels are driven by corresponding drive means which, when started, also enable the abrasive belt to slide.

5. The machine according to claim 2, further comprising at least one cleaning station for removing dust that has accumulated on one part of the abrasive belt while a different part of the abrasive belt is working the panel.

6. The machine according to claim 5, comprising two cleaning stations located between the belt magazines and the pad.

7. The machine according to claim 1 wherein the means for retaining the abrasive belt on the pad alternate between two working conditions, one of which two working conditions holds the abrasive belt securely to the pad and the other of said two working conditions allows the abrasive belt to slide freely relative to the pad so as to change the part of the belt that is in working contact with the panel.

8. The machine according to claim 7 wherein said retaining means comprise a vacuum chamber located between the abrasive belt and the pad and designed to hold the abrasive belt to the pad by negative pressure in said vacuum chamber.

9. The machine according to claim 8, further comprising: first detecting means for detecting a width of the panels being machined; second detecting means for detecting a length of the panels; and a memory device, all being functionally connected to control means which process input signals received from the first and second detecting means to calculate a surface area of the panels as the panels are machined, adding the calculated surface area for the panel being machined to a total surface area machined value and thus updating the total surface area machined value, which total surface area machined value is stored in the memory device, comparing said total surface area machined value with a preset, stored reference value correlated to a useful life of the belt and then issuing commands to slide the belt over the pad in such a way as to distribute belt wear uniformly over an entire length of the belt and indicating the necessity to substitute the belt when the total surface area machined value reaches the preset, stored reference value.

10. The machine according to claim 1, further comprising means for controlling the sliding movements of the abrasive belt and a length by which the belt moves so as to obtain a programmed distribution of wear along an entire length of the abrasive belt.

* * * * *